US005851435A

United States Patent [19]

Chen et al.

[11] Patent Number: 5,851,435

[45] **Date of Patent: *Dec. 22, 1998**

[54] CLEANING COMPOSITION CONTAINING BENZOTRIFLUORIDE

[75] Inventors: Hang-Chang Bobby Chen, Getzville; Edward A. Rowe, Grand Island, both of N.Y.

[73] Assignee: Occidental Chemical Corporation, Niagara Falls, N.Y.

[ * ] Notice: The term of this patent shall not extend beyond the expiration date of Pat. No. 5,756,002.

[21] Appl. No.: 644,145

[22] Filed: May 10, 1996

[51] Int. Cl.[6] ..... B01F 1/00; C23G 5/028; C23G 5/032

[52] U.S. Cl. ..... 252/364; 510/176; 510/200; 510/285; 510/365; 510/407; 510/412; 510/411; 510/409; 510/177

[58] Field of Search ..... 252/364; 510/175, 510/176, 177, 200, 276, 285, 365, 371, 407, 408, 409, 410, 411, 412; 134/38, 40

[56] References Cited

U.S. PATENT DOCUMENTS

| | | | |
|---|---|---|---|
| 4,232,072 | 11/1980 | Pardee | 428/65 |
| 4,578,209 | 3/1986 | Hisamoto et al. . | |
| 5,242,772 | 9/1993 | Kato et al. | 430/49 |
| 5,244,507 | 9/1993 | Rowe | 134/38 |
| 5,578,381 | 11/1996 | Hamada et al. | 428/447 |
| 5,744,437 | 4/1998 | Rowe et al. | 510/204 |

FOREIGN PATENT DOCUMENTS

WO9428196 6/1994 WIPO .

OTHER PUBLICATIONS

CA:125:36361 entitled: "Nonflamable Mixed Solvent Compositions, Cleaning Method, and Apparatus", by Matsuhisa et al. (Apr., 4, 1996).

*Primary Examiner*—Joseph D. Anthony
*Attorney, Agent, or Firm*—Richard D. Fuerle

[57] ABSTRACT

Disclosed is a cleaning composition of about 80 to about 99 wt % benzotrifluoride, about 1 to about 20 wt % monohydric alkanol from $C_1$ to $C_4$, and up to about 20 wt % of a fluorocarbon having the general formula $C_mH_nF_{2m+2n}$, where m is 4 to 8 and n is 1 to m/2 if m is even and (m+1)/2 if m is odd. The composition is useful in cleaning greases, oils, solder fluxes, and other soils.

20 Claims, No Drawings

CLEANING COMPOSITION CONTAINING BENZOTRIFLUORIDE

CROSS-REFERENCE TO RELATED APPLICATIONS

This application is related to application Ser. No. 08/644,143, filed of even date by E. A. Rowe and H. C. Chen, titled, "Cleaning Solvents Containing Benzotrifluoride and Fluorinated Compounds," and to application Ser. No. 08/644,144, also filed of even date by E. A. Rowe and H. C. Chen, titled "Rapidly Evaporating Cleaning Compositions."

BACKGROUND OF THE INVENTION

This invention relates to a cleaning composition containing benzotrifluoride. In particular, it relates to a cleaning composition that is a blend of benzotrifluoride with a monohydric alkanol from $C_1$ to $C_4$.

In manufacturing electronics, textiles, and apparel, it is necessary to remove grease, oil, and other soils left by machinery. In manufacturing electronic components it is often necessary to remove rosin fluxes, which are difficult to remove because they are a mixture of polar and non-polar compounds; specialized solvents are sometimes required for this purpose.

A solvent that was widely used in industry for cleaning is 1,1,1-trichloroethane because it is non-flammable, has a low odor, readily dissolves greases and oils, and has a rapid evaporation rate, which is important for high speed processing. However, 1,1,1-trichloroethane has now been banned because it has been found to be an ozone depletor. As a result, there is a great need in the industry for a substitute solvent that has some or all of the desirable properties of 1,1,1-trichloroethane, but which is not an ozone depletor.

SUMMARY OF THE INVENTION

We have discovered that a cleaning composition can be made from a blend of benzotrifluoride with a monohydric alkanol and an optional fluorocarbon. Although this composition is flammable, it is suitable for uses where flammability is not a problem or where precautions against using a flammable solvent can be taken.

Surprisingly, this composition cleans better than would be expected. That is, the blend of benzotrifluoride and a monohydric alcohol cleans better than does the benzotrifluoride alone or the monohydric alcohol alone. The blend of this invention is particularly suitable for cleaning rosin fluxes.

DESCRIPTION OF THE PREFERRED EMBODIMENTS

The blend of this invention contains about 80 to about 99 wt % benzotrifluoride and about 1 to about 20 wt % of monohydric alkanol. Preferably, the composition contains about 85 to about 95 wt % benzotrifluoride and about 5 to about 15 wt % of the alkanol. It can also contain, as an optional component, up to about 20 wt % of a fluorocarbon to aid in cleaning. Preferably, about 1 to about 15 wt % of a fluorocarbon is included.

Alkanols that are suitable in this invention are monohydric alkanols from $C_1$ to $C_4$, either straight chain or branched. Examples of suitable monohydric alkanols include methanol, ethanol, propanol, isopropanol, normal butanol, tertiary butanol, and isobutanol. The preferred alkanol is isopropanol because it is not a hazardous air pollutant, is readily available, and accepted in the industry.

The optional fluorocarbon has the general formula $$C_mH_nF_{2m+2-n}$$

where m is 4 to 8, and n is 1 to m/2 if m is even, or (m+1)/2 if m is odd. The preferred fluorocarbon is dihydrodecafluoropentane, which has the formula $CF_3CF_2CH_2CF_2CF_3$, because it is commercially available and environmentally acceptable.

The following examples further illustrate this invention.

EXAMPLE 1 (Azeotrope)

The azeotropic composition of benzotrifluoride and alkanol binary mixture was determined by batch distillation using a 10-tray Oldershaw distillation column. The distillation pot was charged with a known amount of the benzotrifluoride and alkanol. The system was brought to a total reflux. Once a stable reflux rate had been established, distillate was removed from the reflux condenser. The distillate composition was determined by gas chromatography analyses.

For each binary mixture, two initial distillation operations were undertaken: one for low concentration of benzotrifluoride (0.5 wt %) in alkanol (99.5 wt %), and the other for low concentration of alkanol (0.5 wt %) in benzotrifluoride (99.5 wt %). If a distillate sample has a higher composition of the less volatile component than its starting material, an azeotrope existed between benzotrifluoride and alkanol mixture between the chosen composition range. By narrowing the composition range and repeating the distillation procedure, the azeotropic composition was approached.

Maximum boiling point azeotropes boil at a temperature greater than the boiling point of the less volatile component, and minimum boiling point azeotropes boil at a temperature less than the boiling point of the more volatile component. Minimum boiling point azeotropes can be approached with fewer distillation trials, because the distillate compositions approach the azeotropic composition.

The following alkanols were selected for the testing with benzotrifluoride: n-propanol, isopropanol, n-butanol, and isobutanol. Benzotrifluoride azeotroped with all four alkanols at compositions of 70 wt % (87° C.), 45 wt % (78° C.), 88 wt % (96.5° C.), and 78 wt % (93.5° C.) for n-propanol, isopropanol, n-butanol, and isobutanol, respectively.

EXAMPLE 2 (Cleaning)

The abilities of solvents to clean mineral oil and solder flux were determined by weight difference. Approximately same amounts, 30 mg of mineral oil or 10 mg of solder flux, were brushed onto 3" by ½" steel coupons and the coupons were weighed. The coated coupons were placed into a 20 ml test solvent for 30 seconds, 2 minutes, and 4 minutes. No agitation was provided. The coupons were taken out, allowed to air dry for at least 30 minutes, and weighed again. The difference in weight measured the extent of cleaning. This test was repeated three times for each solvent and cleaning time combination. The traditional cleaning solvent, 1,1,1-trichloroethane (1,1,1-TCA), was also included for the comparison. In the table, "IPA" is isopropyl alcohol and "HFC-43-10" is 1,1,1,2,3,4,4,5,5,5-decafluoropentane, sold by duPont.

| | 1,1,1-TCA | BTF | 90/10 (by wt) BTF/IPA | 80/15/5 (by wt) BTF/HFC-43-10/IPA |
|---|---|---|---|---|
| | Weight % of Mineral Oil Left On Coupon | | | |
| 30-second cleaning | 3.6 | 1.9 | 4.2 | 4.4 |
| 2-minute cleaning | 1.1 | 0.3 | 0.2 | 0.5 |
| 4-minute cleaning | 0.5 | 0.4 | 0.4 | 0.5 |
| | Weight % of Okorode Solder Flux Left On Coupon | | | |
| 30-second cleaning | 11.3 | 17.1 | 21.3 | 19.0 |
| 2-minute cleaning | 1.5 | 3.5 | 4.2 | 0.7 |
| 4-minute cleaning | 1.3 | 1.6 | 3.3 | 1.6 |

We claim:

1. A composition comprising about 80 to about 99 wt % benzotrifluoride, about 1 to about 20 wt % of a monohydric alkanol from $C_1$ to $C_4$, and about 1 to about 20 wt % of a fluorocarbon having the general formula $C_mH_nF_{2m+2-n}$, where m is 4 to 8 and n is 1 to m/2 if m is even or (m+1)/2 if m is odd, and said composition is suitable for use as a cleaning composition.

2. A composition according to claim 1 wherein said monohydric alkanol is isopropanol.

3. A composition according to claim 1 wherein said monohydric alkanol is methanol.

4. A composition according to claim 1 wherein said monohydric alkanol is ethanol.

5. A composition according to claim 1 wherein said monohydric alkanol is n-propanol.

6. A composition according to claim 5 wherein said monohydric alkanol is n-butanol.

7. A composition according to claim 1 wherein said monohydric alkanol is t-butanol.

8. A composition according to claim 1 wherein said monohydric alkanol is isobutanol.

9. A composition according to claim 1 wherein the amount of said fluorocarbon is about 1 to about 15 wt %.

10. A composition according to claim 9 wherein said fluorocarbon is dihydrodecafluoropentane.

11. A composition according to claim 9 wherein said monohydric alkanol is selected from the group consisting of methanol, ethanol, propanol, isopropanol, n-butanol, t-butanol, and isobutanol.

12. A composition consisting essentially of about 80 to about 99 wt % benzotrifluoride, about 1 to about 20 wt % of a monohydric alkanol from $C_1$ to $C_4$, and up to about 20 wt % of a fluorocarbon having the general formula $C_mH_nF_{2m+2-n}$, where m is 4 to 8 and n is 1 to m/2 if m is even and (m+l)/2 is m is odd and said composition is suitable for use as a cleaning composition.

13. A composition according to claim 12 wherein said monohydric alkanol is isopropanol.

14. A composition according to claim 12 wherein the amount of said fluorocarbon is about 1 to about 15 wt %.

15. A composition according to claim 12 wherein said fluorocarbon is dihydrodecafluoropentane.

16. A composition according to claim 12 wherein said monohydric alkanol is selected from the group consisting of methanol, ethanol, propanol, isopropanol, n-butanol, t-butanol, and isobutanol.

17. A composition comprising about 85 to about 95 wt % benzotrifluoride, about 5 to about 15 wt % monohydric alkanol, and about 1 to about 15 wt % of a fluorocarbon having the general formula $C_mH_nF_{2m+2}$, where m is 4 to 8 and n is 1 to m/2 if m is even and (m+1)/2 if m is odd and said composition is suitable for use as a cleaning composition.

18. A composition according to claim 17 wherein said monohydric alkanol is isopropanol.

19. A composition according to claim 17 wherein said fluorocarbon is dihydrodecafluoropentane.

20. A composition according to claim 17 wherein said monohydric alkanol is selected from the group consisting of methanol, ethanol, propanol, isopropanol, n-butanol, t-butanol, and isobutanol.

* * * * *